US011040808B2

(12) United States Patent
Karll

(10) Patent No.: US 11,040,808 B2
(45) **Date of Patent: *Jun. 22, 2021**

(54) METAL CHILD RESISTANT CONTAINER

(71) Applicant: Nicholas Patrick Karll, Los Angeles, CA (US)

(72) Inventor: Nicholas Patrick Karll, Los Angeles, CA (US)

( * ) Notice: Subject to any disclaimer, the term of this patent is extended or adjusted under 35 U.S.C. 154(b) by 147 days.

This patent is subject to a terminal disclaimer.

(21) Appl. No.: 16/011,267

(22) Filed: Jun. 18, 2018

(65) Prior Publication Data

US 2019/0382170 A1 Dec. 19, 2019

Related U.S. Application Data

(63) Continuation-in-part of application No. 15/951,482, filed on Apr. 12, 2018, now abandoned.

(51) Int. Cl.

| | |
|---|---|
| ***B65D 50/04*** | (2006.01) |
| ***B65D 8/00*** | (2006.01) |
| ***B65D 51/20*** | (2006.01) |

(52) U.S. Cl.

CPC ..... *B65D 50/041* (2013.01); *B65D 7/04* (2013.01); *B65D 51/20* (2013.01); *B65D 2251/0018* (2013.01); *B65D 2251/0093* (2013.01)

(58) Field of Classification Search

CPC .... B65D 50/041; B65D 50/046; B65D 50/04; B65D 51/20; B65D 51/18; B65D 51/24; B65D 1/0246; B65D 1/023; B65D 77/2024; B65D 7/04

USPC ..... 215/220, 219, 217, 228, 232, 44; 220/254.8, 259.4, 259.3, 256.1, 359.3, 220/359.4, 359.1

See application file for complete search history.

(56) References Cited

U.S. PATENT DOCUMENTS

| | | | |
|---|---|---|---|
| 1,356,344 A | 10/1920 | Dister | |
| 2,172,864 A | 9/1939 | Calva | |
| 2,186,338 A | 1/1940 | Mills | |
| 2,359,639 A | 10/1944 | Hanahan | |

(Continued)

FOREIGN PATENT DOCUMENTS

| | | | |
|---|---|---|---|
| GB | 159327 A * | 2/1921 | ..... B65D 51/18 |
| GB | 1377785 | 12/1974 | |
| WO | WO-9301098 A2 * | 1/1993 | ..... B65D 41/48 |

OTHER PUBLICATIONS

Tin Canna (TM) website information Accessed Sep. 19, 2019, https://tin-canna.com/tin-canna/ Inventor Nicholas Patrick Karll listed as Founder and CEO—Eco Packaging Solutions (Year: 2019).

(Continued)

*Primary Examiner* — Robert J Hicks

(74) *Attorney, Agent, or Firm* — Mackey Law Firm PLLC

(57) ABSTRACT

A metal child resistant container with a screw lid that comprises a main body, an inner cap that screws on to the main body forming an air tight seal, and an outer cap that is located over the inner cap. The outer cap prevents the user from directly interacting with the inner cap and requires the user to apply pressure to the outer cap. The inner cap has indentions that match with similar indentions stamped in or attached to the outer cap. When pressure is applied to the outer cap the inner cap and outer cap mover as one allowing the container to the open and closed. The container is further sealed by a foil seal and a desiccant material.

33 Claims, 7 Drawing Sheets

(56) References Cited

U.S. PATENT DOCUMENTS 2,364,126 A * 12/1944 Cantor ..... B65D 81/3205 215/247
2,864,519 A 12/1958 Crabbe
2,980,274 A 4/1961 Gould
3,055,524 A 9/1962 Glasbrenner
3,097,756 A * 7/1963 Dorsey ..... B65D 50/068 215/215
3,343,697 A 9/1967 Roberts et al.
3,396,864 A 8/1968 Jones et al.
3,472,410 A 10/1969 Turner
3,472,411 A * 10/1969 Turner ..... B65D 50/041 215/220
3,638,819 A * 2/1972 Roy ..... B65D 50/041 215/220
3,679,085 A 7/1972 Gach
3,764,033 A 10/1973 Smith et al.
3,830,390 A * 8/1974 Gach ..... B65D 50/041 215/220
D232,916 S 9/1974 Bettonica
3,843,008 A 10/1974 Colella
3,926,328 A 12/1975 Cistone
3,946,890 A 3/1976 Scuderi
4,004,704 A 1/1977 Hilaire
4,011,960 A 3/1977 Mauvernay et al.
4,223,799 A 9/1980 Eyster et al.
4,241,840 A 12/1980 Willis
4,284,201 A 8/1981 Nixon
4,319,690 A 3/1982 Birrell et al.
4,410,098 A 10/1983 Dubs et al.
4,433,789 A 2/1984 Gibilisco
4,605,136 A * 8/1986 Debetencourt ..... B65D 51/20 215/232
4,957,210 A 9/1990 Kusz
5,219,084 A * 6/1993 King ..... B65D 1/02 215/220
5,234,118 A * 8/1993 Fillmore ..... B65D 50/068 215/206
5,280,842 A 1/1994 Koo
5,316,161 A 5/1994 Gargione
5,332,113 A * 7/1994 Kusler, III ..... A61J 1/1406 215/232
5,370,251 A 12/1994 Buono
5,433,329 A * 7/1995 Weinstein ..... B65D 50/041 215/219
5,437,382 A 8/1995 Gluckman
5,524,779 A 6/1996 Faile
6,206,216 B1 3/2001 Stalions
6,477,823 B1 * 11/2002 Kitterman ..... B65B 7/168 215/344
7,337,929 B2 3/2008 Winckels
D565,412 S 4/2008 Fuller
D577,290 S 9/2008 Moretti
D578,891 S 10/2008 Canamasas Puigbo
8,056,742 B2 11/2011 Brozell et al.
8,863,947 B2 10/2014 Sibley
D797,559 S 9/2017 Lerman
9,878,821 B2 1/2018 Sibley
10,232,990 B2 3/2019 Sang
10,513,375 B2 12/2019 Karll
2004/0262251 A1 12/2004 Tauber
2007/0110928 A1 5/2007 Bried et al.
2009/0028841 A1 * 1/2009 Gohil ..... A23L 3/3436 424/94.4
2009/0120900 A1 * 5/2009 Mitadera ..... B32B 27/36 215/382
2012/0048825 A1 * 3/2012 Averett ..... B65B 55/19 215/232
2016/0106149 A1 4/2016 Potter et al.
2017/0113851 A1 4/2017 Martin et al.
2017/0355495 A1 12/2017 Martin et al.
2018/0037395 A1 * 2/2018 Kneer ..... B65D 41/16
2018/0319556 A1 11/2018 Straughan
2019/0263569 A1 * 8/2019 Smith ..... B65D 50/041

OTHER PUBLICATIONS

Written Opinion of the International Searching Authority and International Search Report dated Aug. 15, 2019 for International Application No. PCT/US2019/027049.

* cited by examiner

METAL CHILD RESISTANT CONTAINER

CROSS REFERENCE TO RELATED APPLICATIONS

This Application is a continuation-in-part of U.S. patent application Ser. No. 15/951,482 filed on Apr. 12, 2018.

FIELD OF INVENTION

The invention relates to a child resistant container with a screw lid.

BACKGROUND INFORMATION

This invention relates to child resistant packaging. In particular, this invention relates to products that require metal containers such as combustibles or flammable solvents like alcohols, toluene, and hexane. Chlorinated solvents are another type of liquid that is best suited for metal containers. Metal containers also protect the products held within from UV degradation.

Some states have enacted laws requiring products that are susceptible to dangerous misuse by children be sold by retailers in child resistant packaging. Examples of such products include medicines, pills, gels, and other similar substances. Some child resistant packaging, such as one-time opening clamshell designs and blister packaging, cannot be resealed after the substance is accessed. Other child resistant packaging products that are resealable, such as plastic pill bottles, cannot use modern preservation techniques to extend the shelf life of the contained substance. A metal child-resistant container is also better suited than a plastic pill bottle for laser etched or engraved tracking information. In the case of etching or engraving on a malleable substance like plastic makes it easy for the tracking information to be scratched off or distorted in other ways that makes the tracking information indecipherable. Many consumers are also concerned about the state of the environment and want products that can be recycled easily. Plastic pill bottles and other packaging are made of materials that are not accepted at many recycling processing plants or have a limited lifecycle. Another concern of consumers' is that plastics are known to leach chemicals into the products they come into contact with. For things such as medication this is a big concern for people with compromised immune systems. This invention will be made of a recyclable metal alloy that is accepted by virtually all recycling processors. The present invention differs from current products on the market in that it can be opened and closed multiple times without loss of function, is easily recyclable, and can preserve the contents of the container better than similar products.

The present invention differs from most childproof packages on the market in that it can be used to store a substance itself in addition to pre-packaged product that may not come equipped with a childproofing device while being all metal and 100% recyclable as it uses no adhesives of any sort.

SUMMARY OF INVENTION

The objective of this invention is to produce a child resistant metal container that can be resealed, recycled, and is capable of using preservation techniques to store the contained substance longer than other containers. The container is made of a recyclable metal and uses a twist or screw off mechanism that generates an air tight seal. There are three to four pieces; a container lid, a container body, a locking disk and a locking cap.

The container body is a metal cylinder tube with a solid, closed "base" and an open "top" opposite of the base. This is where the contained product rests. A main body, which holds the product. A recessed lip is manufactured into the open top of the container body. This recessed lip has screw threads manufactured into the side walls that compliment and accommodate matching threads manufactured into the locking cap.

The locking cap is a metal cylindrical tube piece with an "open" end at the base and a "closed" portion at the top. The locking cap is manufactured to a dimension that fits snuggly on the recessed lip of the container body and under the locking plate and container lid. Manufactured into the side walls of the locking cap are screw threads that compliment and accommodate those found on the recessed lip of the container body. Manufactured into the superior exterior surface plane of the locking cap "closed" top piece is a series of depressions that compliment and accommodate a matching set of depressions manufactured into the superior plane of the locking plate.

The locking plate is a cylindrical plate that fits between the locking cap and the container lid. Depressions identical in size and dimension to those on the locking cap are manufactured into the surface of the plate.

When opposing pressure is applied to the container cap against the container body and the depressions of the locking plate and locking cap are aligned, the container lid and locking cap depress slightly in the recessed lip. The user can then twist the container cap or body, causing the angled screw threads to catch and separate the lid from the body. Without this pressure, the container lid is designed to spin about the inner locking cap without opening, enhancing this product's child safety features.

In alternative embodiments it is possible to create the same multi-piece lid design while the body of the container can be bowl shaped instead of cylindrical. This bowl-shaped body allows for more efficient packaging for shipping and storage. The bowl design is nest-able. In alternative embodiments is possible to create the same multi-piece lid design while the body of the container can be made of spiral wound tubing with a metal bottom cap and threaded metal top of the body. In alternative embodiments it is possible to create the same multi-piece lid design while the body of the container can be a 3 piece metal body consisting of rolled tube, bottom cap, and top cap with threading. In alternative embodiments it is possible to create the same multi-piece lid design while the body of the container can be glass.

Alternative embodiments include the addition of an aluminum foil seal attached the inward rolled lip on the main body of the containing. This Aluminum foil seal acts as a barrier to light, moister, odors and is a tamper evident seal. A desiccant and oxygen scavenge material is added to the inside surface of the aluminum foil seal that absorbs oxygen, and hold the moister content of the container to a desirable level. The desiccant and oxygen scavenge material may be self adhering the foil seal or require an adhesive. Alternatively, the desiccant and oxygen scavenge material may act as an adhesive for the foil seal to attach to the container.

BRIEF DESCRIPTION OF THE DRAWINGS

FIG. 2A depicts a side view, revealing the inward recessed lip and the screw thread. FIG. 2B depicts a single angled thread that extends over the entire circumference of the container.

FIG. 8A depicts desiccant material and/or oxygen scavenging material applied as a rectangular strip on the foil seal. FIG. 8C depicts the desiccant material and/or oxygen scavenging material as two rectangular strips on the foil seal.

FIG. 9A depicts the foil seal on the main body with a circular viewing window in the center. FIG. 9B depicts the viewing window from the product facing side that shows the desiccant material and or oxygen scavenging material in a ring shape around the viewing window.

DETAILED DESCRIPTION

This application relates to a child resistant container. The container requires the user to apply opposing pressure to the top and bottom of the device to engage embossed features located on the outer and inner cap to lock. Once engaged, the user twists and places complimentary angled screw threads engineered into the interior walls of the inner cap 05 and exterior walls of the container body into contact with each other. Once in contact, the user twists engaging the screw threads and unscrewing the container lip from the container body. When closed, the container is air tight, allowing the container to safety store its contents for extended periods of time. Further, due to the air tight nature the gas inside the container when its contents are packaged may be altered to have a less reactive gas inside to prevent decay. A high barrier sealing or lidding film can also be affixed on the top of the body of the container to maintain the specific atmosphere even after the lid is removed. This allows for the contents of the container to be visually inspected without disturbing the specific atmosphere of the container. Once this sealing or lidding film is removed the specific atmosphere of the container is no longer contained.

The container is made completely out of metal. The metals may include steel, tin, copper, aluminum or alloys thereof. Metal containers prevents BPA leaching, and chemical leaching into the stored product. Another advantage metal has over plastic is that track and trace information can be laser etched onto the container and not be easily be removed. Metal containers have the further advantage over plastic of being more recyclable in comparison.

Figure 1:
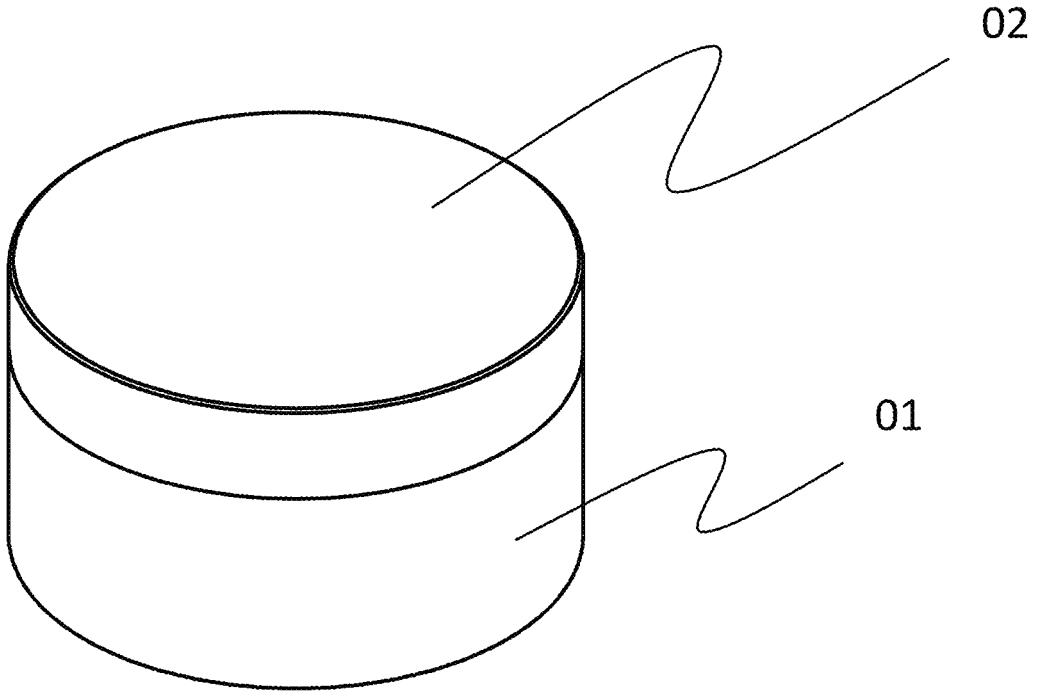
FIG. 1 depicts an external view of the container body and container lid in the closed configuration.

FIG. 1 depicts the preferred embodiment of the claimed invention. The child resistant container in FIG. 1 show the container body 01 on the bottom and the outer cap 02 resting on top of it. The area where the outer cap 02 and the container body 01 meet has a seamless edge. In this depiction the outer cap 02 has a smooth top. This embodiment will have a center plate 10 that is attached to the inside of the outer cap 02 or placed between 02 and 05. In order to open the user must press on the main body 01 and the outer plate 02 together while applying horizontal rotational force to unscrew the caps from the main body 01.

A preferred embodiment of the container has a height between 25 mm and 200 mm and a diameter of between 60 mm and 120 mm in the closed configuration. However, these dimensions may vary in various embodiments.

Figure 2A:
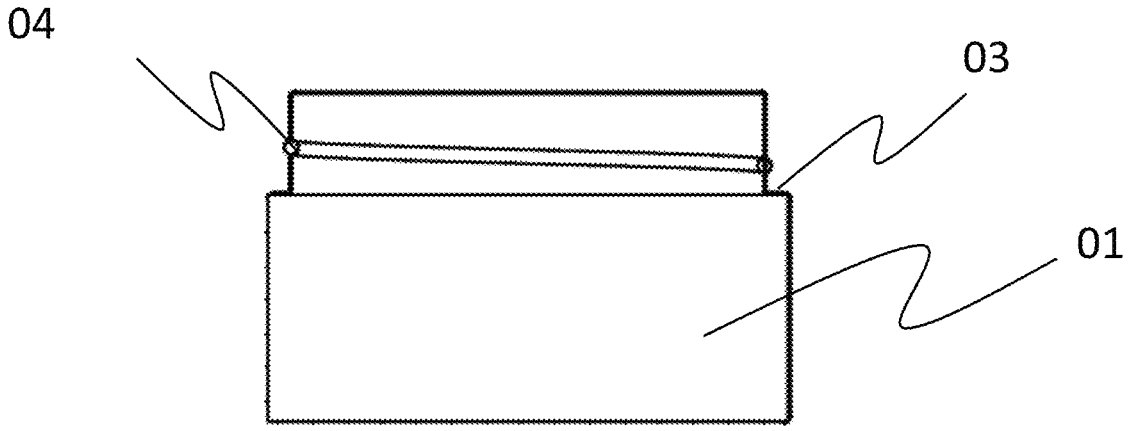
FIGS. 2A and 2B depict the container body.

FIG. 2A depicts the container body 01. The container body 01 is comprised out of aluminum, however other metals may be used including steel, tin, copper, aluminum or alloys thereof. Other material combinations included tin plated steel, or copper plated steel. The container body 01 is cup-shaped with a recessed neck 03 at the top portion where it will meet the outer cap 02 and a threaded portion extending further upward where the container body will contact the inner cap 05. The thread on the container body 04 is a one half or three-quarter, or one full turn, or double turn. However, the thread 04 is not to be greater than two full turns, in order to prevent slipping of the threads on the inner cap 05 with the thread on the outer cap 02 when the user applies pressure to the outer cap 02 and container body 01. Due to the nature of the locking mechanism there are limits to how much force can be applied to unscrew the inner cap 05 from the outer cap, and therefore it is important to avoid the product becoming jammed. To this end there is only a single thread present and it will not have a thread engineered to result in more than one turn or two turns.

The main body in one preferred embodiment has a diameter of 68 mm and a height of the body before the inward rolled edge is 30.72 mm. The section with the threads is smaller has a diameter of 61.67 mm. However, the inward rolled edge will vary on the diameter of the container.

In alternative embodiments a lidding film or sealing film may be used over the opening of the main body 01 in order to create an air tight seal. The lidding film or sealing film is applied during packaging of the product, and may be combined with the use of an inert gas for storage of the product stored in the main body.

Figure 2B:
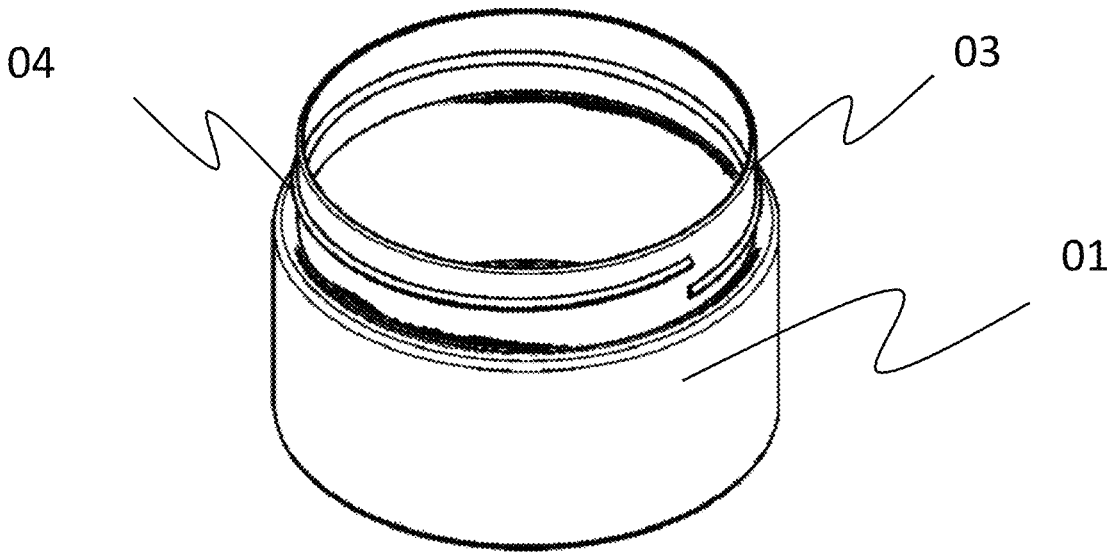

FIG. 2B is another view of the main body 01 that better depicts the inward rolled edge 07 and recessed lip 03 and the thread 04 sections of the main body 01. In the embodiment shown in FIG. 2B the threaded section goes 360 degrees around the top of the container body but does not overlap. The recessed lip 03 depicted allows the inner cap and the outer cap to be in place while creating a seamless edge on the outside of the container. The inward rolled edge 07 wraps around the top of the opening to the main body 01. When a lidding film or induction film is to be applied the inward rolled edge 07 form a flat surface at least 2 mm thick for the lidding film or induction film to bond.

Figure 3:
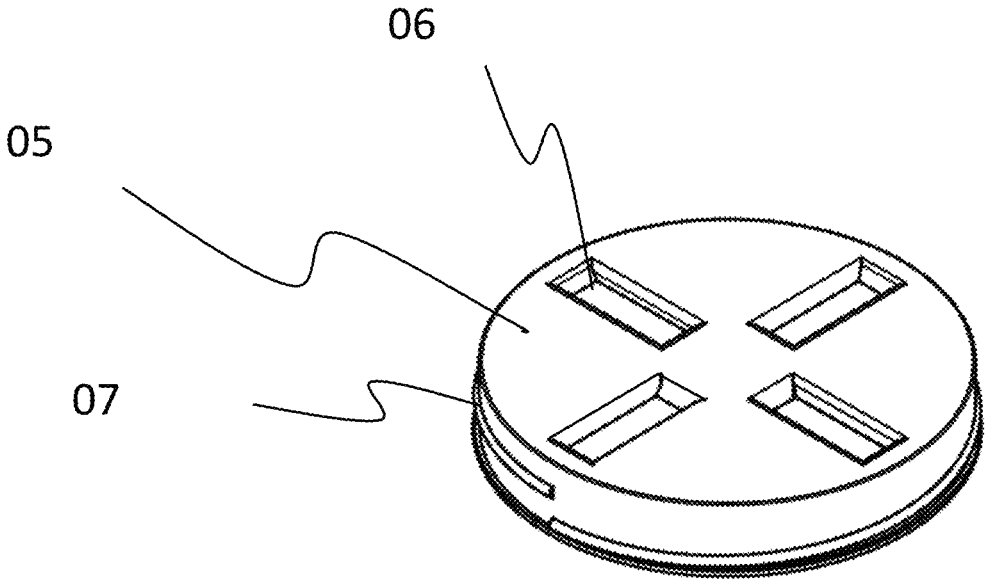
FIG. 3 depicts the inner cap and an embodiment of the depressions on the inner cap that the outer cap or center plate fits into.

FIG. 3 depicts the inner cap 05. The inner cap 05 also has one or more indentations 06 on its top surface. These indentions 06 match indentations that are present on either the center locking plate 10 or the outer cap 02 and are the point of where the pressure from the user is converted into friction allowing the container to be opened. The pattern of the indention may vary from embodiment to embodiment. The preferred embodiment depicted in FIG. 3 is a cross formation that is either four rectangular sections forming a cross, or a continuous cross shape in the middle of the top of the inner cap.

Alternatively, the indentation may be any shape that allows there to be an edge in the clockwise direction and counter clockwise direction. Four rectangular indentations 06, or one cross indention 11 are preferred, other combinations may include two indentations, a single linear indentation, a curved indentation, or multiple indentions, of two, three, four, five, six, seven, eight, or more equally, or unequally spaced indentations with a clockwise edge or counter clockwise edge. More indentations will be used in larger containers, and less indentations will be used in smaller containers. In embodiments with a diameter below 70 mm no more than four indentations should be used. In order to prevent ripping of the material in manufacturing the indentation will need to be thick between 4.5 mm and 6 mm thick. The inner cap 05 has threads 04 that correspond to the threads on the main body 01, allowing the inner cap to unscrew off of the main body. This occurs when the user applies pressure to the outer cap onto the inner cap and turning the inner cap relative to the outer cap.

The inner cap 05 is held inside of the outer cap 02 by an inward rolled edge on the outer cap (not shown). Similar to the inward rolled edge on the main body 07 the inward rolled edge is at the end of the open end of the cap and causes the material on the outer cap to be formed inward creating a ledge. On the outer cap 02 the ledge holds the inner cap 05 inside of 02 and prevents the inner cap from sliding out of the outer cap, while allowing the inner cap 05 to float, and rotate inside of the outer cap 02. The inward rolled edge must be large enough to hold the inner cap 05 in place inside of the outer cap 02.

Figure 4:
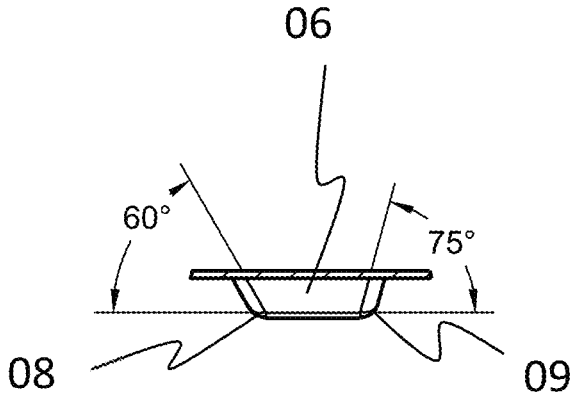
FIG. 4 depicts a cross section of a preferred embodiment of the indentations on the inner cap and center plate.

FIG. 4 depicts a cross section of the indentation on the inner cap 05 and on the center plate 10 or outer cap 02. Two different angles are used on each edge, in order to resolve the issue of overtightening, the container and making it difficult to open. The two different angles: the working edge 09 and the open edge 08, the working edge 09 is the edge that is in the counter clockwise direction of the indentations and provides the force during the closing of the container. The open edge 08 is the edge that is on the clockwise direction of the indentations 06 that provides the force that opens the container so long as opposing pressure is applied to 02. The preferred embodiment the working edge 09 is 75 degrees, or the range or 70 to 80 degrees from the horizontal as to allow the cap to close, but not enough to over tighten and make opening to difficult. The angle allows the mechanism to disengage when it s sealed tight. When the mechanism is sealed tight the mechanism will skip, preventing overtightening. The open edge 08 is 60 degrees from the horizontal which decreases the amount of twist force to be exerted compensating for the closing motion while still requiring a push-down and twist motion to open the container. The range of 40 to 60 degrees from the horizontal may be used for the open edge. This allows the mechanism to operate with enough difficulty to achieve the child resistant requirements but not so difficult that adults are unable to reliably open the device.

Figure 5A:
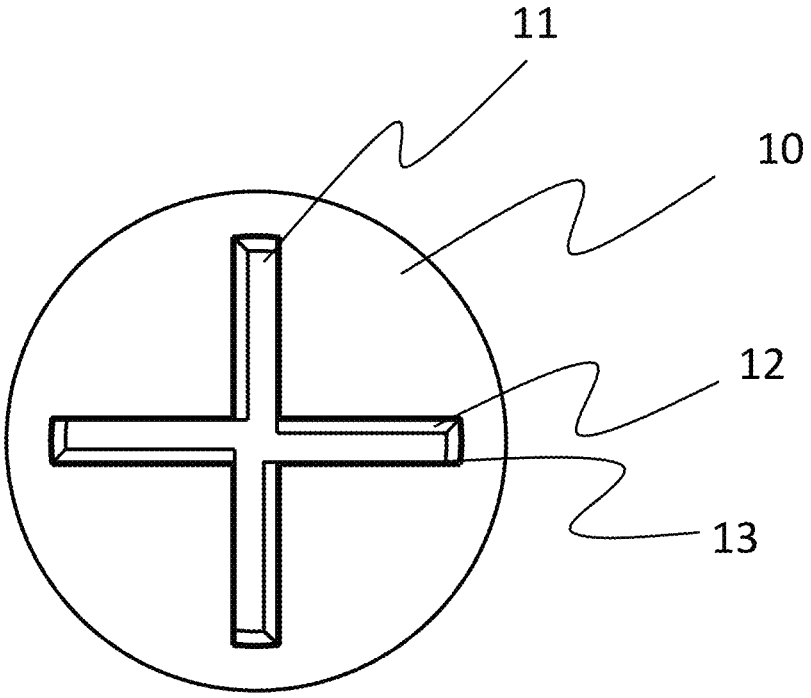
FIGS. 5A and 5B depict a top down view of alternative embodiments of the center plate.

In preferred embodiments the indentations have a depth of 0.85 mm with a width of 5.27 mm and a length of 16.62 mm. FIG. 5A depicts the center plate 10, which is located between the inner cap 05 and the outer cap 02. Depending on the specific embodiment, the center plate 10 may be attached to the inner cap 05 or the outer cap 02 through an adhesive or other bonding measure. In the preferred embodiment, the center plate 10 is placed in between the outer cap 02 and the inner cap 05 without adhesive or another bonding agent. The center plate 10 has indentations 11 that match and fit into the indentations 06 on the inner cap 05. When pressed together, the center plate 10 and inner cap cap's 05 indentations fit into each other and allow the locking plate, inner cap, and outer cap to be unscrewed and separated from the container body. The indentation 11 in FIG. 5A is a single indention that is cross shaped. There is a clear working edge 12 which is clearly defined and open edge 13 on the clockwise side of the indention is less clear as a result of the steeper angle.

The center locking plate 10 is used in embodiments where the indentations are not manufactured into the outer cap 02. In the case that the outer cap 02 requires a smoother top surface, the inner plate 05 is affixed to the inside of the outer cap 02, so the outer cap is used to press down onto the inner cap 05 allowing the outer cap 02 to turn as one.

Figure 5B:
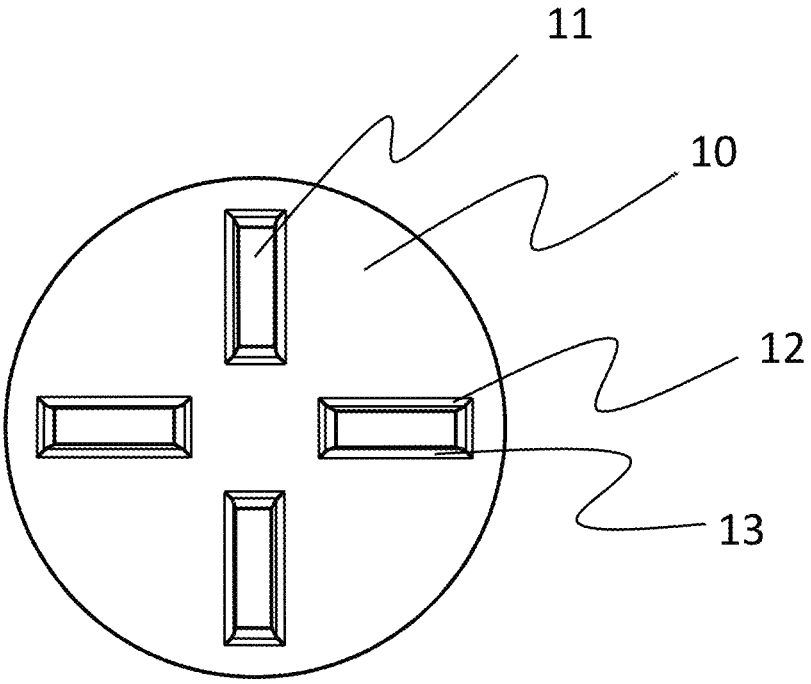

FIG. 5B is an alternative embodiment of the center plate 10 with 4 separate indentations 11, arranged similarly to the cross embodiment, however the center is not stamped.

Figure 6:
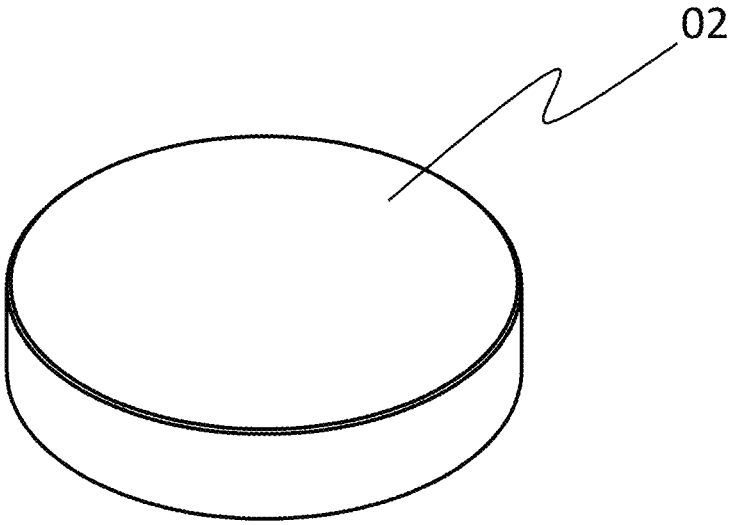
FIG. 6 depicts the container cap that with a smooth top, that would require the application of the center plate.

In a preferred embodiment the diameter of the center plate 10 is 66 mm. There are 4 indentations extending from the center outward in a cross pattern. The indentations are each 4.79 mm in width and 15.82 mm in length allowing them to fit inside of the indentation on the inner cap. FIG. 6 depicts the outer cap 02. The outer cap 02 rests over the inner cap 05 and locking plate 10 and it meets the container body 01 at the start of the recessed lip 03, forming a seamless edge. The outer cap 02 has an inward rolled edge on the edge of its open end (not shown) which creates a channel that hold the inner cap 05. The inner cap 05 fits in the channel such that it cannot exit the channels, however it is able to float inside of the channel, and freely rotate. The fit of the outer cap 02 on the inner cap 05 is loose enough that turning the outer cap 02 will not turn the inner cap 05 against the resistance of the container body 01. When the outer cap 02 is pushed down by the user, it locks with the inner cap 05 through the indentations 06 on the inner cap 05 locking plate 10 and allows the outer cap 02 to be separated from the container body 01 and either the center plate 10 or indentation on the outer cap 02.

The indentations themselves vary in size from embodiment to embodiment and the size of the of the indentations vary depending on the number of indentations and size of the container.

In alternative embodiments the outer cap 02 will be stamped with the indentations instead of using a center plate 05. Such a design would consist of three pieces, allowing the outer cap 02 to directly interact with the inner cap 05. In this embodiment, the indentations 06 are manufactured into the outer cap 02 interact with the indentations on the inner cap 05. The same angles would be used in the case where the outer cap 02 does not have indentations.

In alternative embodiments when the outer cap does not require a smooth superior exterior surface plane, the center plate 10 (with the embossing which matches the locking cap) can be removed from the design. Replaced by the embossing manufactured into the superior exterior surface plane of the outer cap 02 which matches the locking cap. This makes the lid a 2-piece lid whereas the design with the center plate is a 3-piece lid.

In various embodiments the locking, mechanisms taught above can be applied to various forms of containers. In such embodiments the main body will change in design, and the inner cap 05, outer cap 02, and locking plate will remain largely the same, only changing in size to match the change the dimensions of the new container body.

Figure 7:
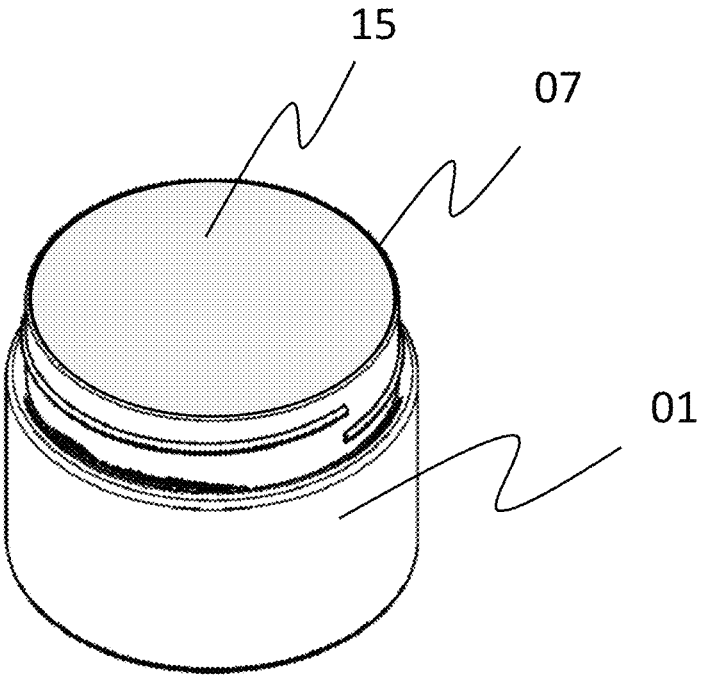
FIG. 7 depicts an embodiment incorporating an aluminum foil seal applied over the opening of the main body.

FIG. 7 depicts an alternative embodiment, as shown in FIG. 2B, further including a multi-layer aluminum foil seal 15 where the multilayer aluminum foil seal 15 is located over the opening to the main body section of the container and is attached to the inward rolled edge 07. The multi-layer aluminum foil seal 15 seals to the main body through a heat activated adhesive coating, and that has a predetermined amount of a desiccant material and or oxygen scavenge material applied to the product facing side of the foil seal 15. (Not Shown). The seal may be sealed through induction or conduction sealing. The aluminum foil seal 15 provides a tamper evident seal, that may be used in addition to the tamper evident seal on the outside of the container, as a replacement of the external tamper evident seal. Additionally, the aluminum foil seal 15 provide a barrier to light, oxygen, water, and odors.

In a preferred embodiment the aluminum foil seal 15 will be contact conduction sealed to the inward rolled edge 07 of the body of the metal child-resistant container. The foil seal will be either flat or recessed. The foil seal 15 will have protective lacquer layer, an aluminum foil layer, and an extrusion coating layer with a heat activated adhesive.

The desiccant material and or oxygen scavenge material may include activated alumina, aerogel, benzophenone, bentonite clay, calcium chloride, calcium oxide, calcium sulfate (drierite), cobalt(II) chloride, copper(II) sulfate, lithium chloride, lithium bromide, magnesium sulfate, magnesium perchlorate, molecular sieve, potassium carbonate, potassium hydroxide, silica gel, sodium, sodium chlorate, sodium chloride, sodium hydroxide, sodium sulfate, sucrose, or sulfuric acid, ferrous carbonate, metal halide catalyst, ascorbate, sodium hydrogen carbonate, citrus, and/or Ascorbic acid. The amount and material makeup of the desiccant and oxygen scavenge material is specifically designed to maintain a relative humidity (RH) inside the container of between 50-65%. The desiccant and oxygen scavenging material may be applied to a smaller portion of the foil seal allowing the heat activated adhesive layer to still function properly, this reduces the need for nitrogen flushing and separate desiccant packets. The desiccant and oxygen scavenging material may be able to be applied to the foil seal through heat stacking or an adhesive.

Figure 8A:
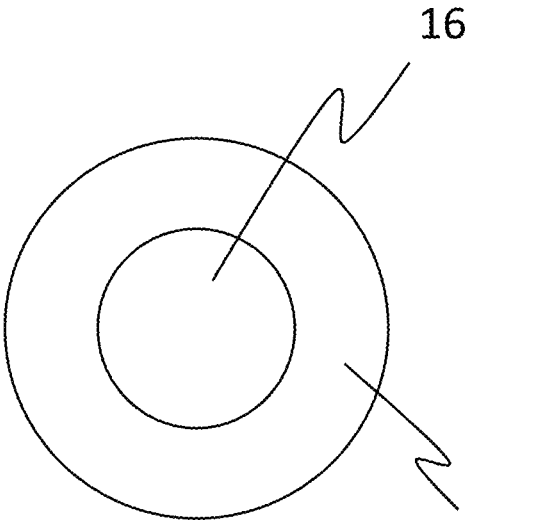
FIGS. 8A, 8B and 8C depicts the desiccant material and/or oxygen scavenging material on the foil seal.
Figure 8B:
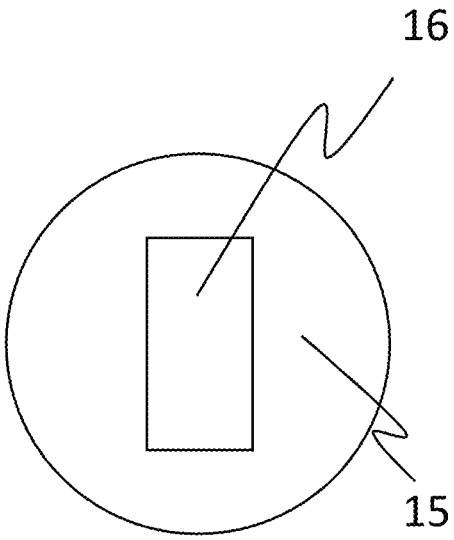
Figure 8C:
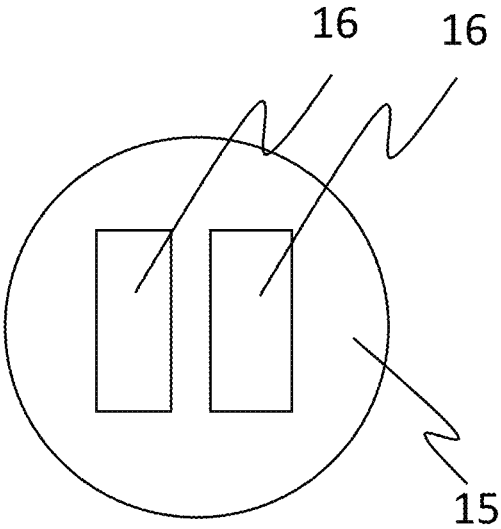

FIGS. 8A, 8B, and 8C depict various embodiments if the application of the desiccant material and or oxygen scavenging material 16 attached to the foil seal 15, viewed from the inside of the container. FIG. 8A depicts the use of a circular piece of desiccant material and/or oxygen scavenging material 16 attached to the inside of the foil seal 15. The desiccant material and/or oxygen scavenging material 16 may be made as large or small a necessary to create the desired atmosphere inside the container. FIG. 8B depicts the use of a rectangular strip of desiccant material and/or oxygen scavenging material 16 attached to the inside of the foil seal 15. Alternatively, square shaped desiccant material and/or oxygen scavenging material 16 may be used. FIG. 8C depicts an embodiment where there are two desiccant material and/or oxygen scavenging material strips 16 attached to the foil seal 15. This embodiment allows for different amounts of desiccant material and/or oxygen scavenging material 16 to be used to create the desired atmosphere inside the container.

Figure 9A:
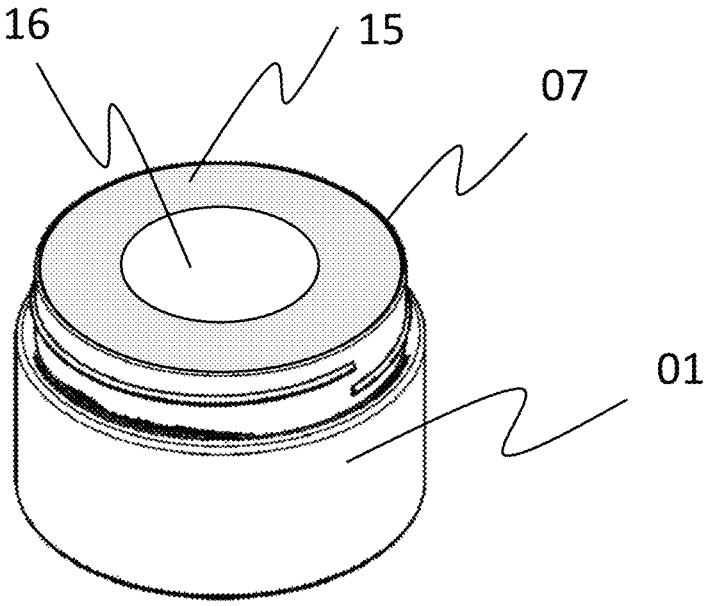
FIGS. 9A and 9B, depicts the foil seal with a viewing window.
Figure 9B:
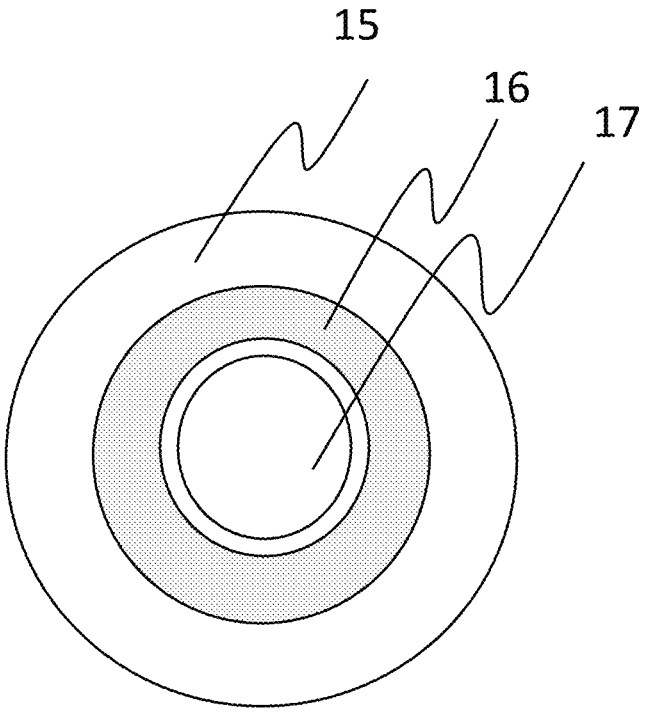

FIGS. 9A and 9B depicts an alternative embodiment of the preferred invention adding a viewing window 17 to the foil seal 15 and an exposed hole in the foil seal covered by the clear film 17. The Viewing window allows the product stored and sealed in the container to be viewed without the seal being broken, allowing customers to view the product and know the seal, and product were not tampered with. The viewing window 17 itself comprised of a hole in the foil seal, sealed with a clear film bonded to the foil seal. FIG. 9A depicts the foil seal 15 and viewing window 17 in relation to the main body 01. The clear file of the viewing window 17 may be attached to the foil seal 15 through various bonding techniques. The clear film may be attached to the foil seal 15 on the side facing the product or on the side facing the cap. FIG. 9B depicts the product facing side, where the viewing window 17 in in the center and the desiccant material and or oxygen scavenging material 16 is in a doughnut shape surrounding the clear film. Optionally the clear film may be sandwiched between the desiccant material and or oxygen scavenging material 16 and foil seal 15 at the edges of the clear film. Alternatively, the viewing window 17 may be offset to one side of the foil seal, and the clear film is attached to the foil seal 15, while the desiccant material and or oxygen scavenging material 16 is located on the foil seal 15 at a location where the viewing window is not located. Alternatively, the desiccant material and or oxygen scavenging material 16 may be in one or more separate locations on the product facing surface of the foil seal 15 that does not overlap the viewing window 17.

Alternative embodiments may include a bowl design, that replaces the cup design of the main body. By using a bowl shape instead of a cup shape more efficient packaging and storage is possible, because bowls are nest-able.

Alternative embodiments include the use of the same multi lid design with a spiral wound tubing with a bottom cap. The spiral wound tubing may be paper tubes, paper cores, cardboard tubes, chip board tubes, or plastic tubes. The bottom cap may be metal, or plastic.

Alternatively, it is possible to create the same multi-piece lid design while the body of the container can be a 3-piece metal body comprising of rolled seamed tube, bottom cap, and top cap with threading.

Alternative embodiments may include a viewing window, in the outer cap 02, inner cap 05, center plate 10, main body 01 or combination thereof, to allow the product stored inside to the viewed without opening the container.

Additional alternative embodiments allow for there to be a hermetically sealed main container. The three pieces, or two-piece lid design is then used over the hermetically sealed main body. When the customer opens the lid and seal the customer is then able to reseal the container in an air tight seal.

Various alterations and modifications may be made to the present invention without departing from the scope of the invention. For example, although particular embodiments refer to the shape of the indentations in the various drawings, this is in no way intended to be limiting as, in use, the present invention may be implemented using different configuration which are used for various products.

What is claimed is:

1. A child resistant container comprising:

a container body having a closed base and an open top, wherein the open top has a recessed lip and a pinched neck that is threaded;

wherein the pinched neck has an inwardly rolled edge and a mouth that is sealed by a multilayer seal comprising a window in the seal that allows a product disposed within the container body to be viewed without breaking the seal;

wherein the seal has a product-facing side;

wherein the seal has desiccant material and/or oxygen scavenging material applied in at least one patch to the product facing side of the seal;

an inner cap, wherein the inner cap comprises threads to screw the inner cap to the container body and indentations stamped into the inner cap;

an outer cap, wherein the outer cap rests over the inner cap and has indentations stamped into or attached to the outer cap and configured to couple with the indentations on the inner cap;

wherein when pressure is applied to the outer cap and container body and the indentations of the inner cap and outer cap are coupled to one another, the coupled indentations enable the outer cap and inner cap to move as one to screw the inner cap onto or off of the container body.

2. The child resistant container of claim 1, wherein the multilayer seal comprises a layer of aluminum foil attached to the inwardly rolled edge.

3. The child resistant container of claim 1, wherein the at least one patch is configured so that the desiccant material and/or oxygen scavenging material is not viewable through the window when the seal is coupled to the container body.

4. The child resistant container of claim 1, wherein the window is comprised of a clear film sandwiched between a foil layer of the seal and the at least one patch, and wherein the at least one patch comprises an opening disposed about the window.

5. The child resistant container of claim 4, wherein the foil layer comprises aluminum foil.

6. The child resistant container of claim 1, wherein the window comprises a clear film disposed on a side of the seal opposite the product-facing side, and wherein the desiccant material and/or oxygen scavenging material is not viewable through the window when the seal is coupled to the container body.

7. The child resistant container of claim 1, wherein the seal is attached to the inwardly rolled edge.

8. The child resistant container of claim 1, wherein at least a portion of the seal overlaps the inwardly rolled edge and is disposed on the pinched neck.

9. The child resistant container of claim 1, wherein the seal comprises a heat activated adhesive.

10. The child resistant container of claim 1, wherein the desiccant material and/or oxygen scavenging material comprises at least one of activated alumina, aerogel, benzophenone, bentonite clay, calcium chloride, calcium oxide, calcium sulfate, cobalt(II) chloride, copper(II) sulfate, lithium chloride, lithium bromide, magnesium sulfate, magnesium perchlorate, molecular sieve, potassium carbonate, potassium hydroxide, silica gel, sodium, sodium chlorate, sodium chloride, sodium hydroxide, sodium sulfate, sucrose, sulfuric acid, ferrous carbonate, metal halide catalyst, ascorbate, sodium hydrogen carbonate, citrus, ascorbic acid and a combination thereof.

11. The child resistant container of claim 1, wherein the desiccant material and/or oxygen scavenging material is configured to maintain a relative humidity (RH) of between 50-65% inside the container.

12. The child resistant container of claim 1, wherein the desiccant material and/or oxygen scavenging material comprises two or more desiccant materials and/or oxygen scavenging materials of different compositions.

13. The child resistant container of claim 1, wherein the at least one patch of desiccant material and/or oxygen scavenging material is circular, rectangular or square.

14. The child resistant container of claim 1, wherein the outer cap is the outermost cap of the container.

15. A child resistant container comprising:

a container body having a closed base and an open top, wherein the open top has a recessed lip and a pinched neck that is threaded;

wherein the pinched neck has an inwardly rolled edge and a mouth that is sealed by a multilayer seal comprising a window in the seal that allows a product disposed within the container body to be viewed without breaking the seal;

wherein the seal has a product-facing side;

wherein the seal has desiccant material and/or oxygen scavenging material coupled to the product facing side of the seal;

wherein the window comprises a clear film coupled to a foil layer of the seal and to the desiccant material and/or oxygen scavenging material;

an inner cap, wherein the inner cap comprises threads to screw the inner cap to the container body and indentations stamped into the inner cap;

an outer cap, wherein the outer cap rests over the inner cap and has indentations stamped into or attached to the outer cap and configured to couple with the indentations on the inner cap;

wherein when pressure is applied to the outer cap and container body and the indentations of the inner cap and outer cap are coupled to one another, the coupled indentations enable the outer cap and inner cap to move as one to screw the inner cap onto or off of the container body.

16. The child resistant container of claim 15, wherein the foil layer comprises aluminum foil and wherein the foil layer is attached to the inwardly rolled edge.

17. The child resistant container of claim 15, wherein at least a portion of the seal overlaps the inwardly rolled edge and is disposed on the pinched neck, and wherein the outer cap is the outermost cap of the container.

18. The child resistant container of claim 15, wherein the desiccant material and/or oxygen scavenging material is configured to maintain a relative humidity (RH) of between 50-65% inside the container.

19. The child resistant container of claim 15, wherein the desiccant material and/or oxygen scavenging material comprises two or more desiccant materials and/or oxygen scavenging materials of different compositions.

20. A child resistant container comprising:

a container body having a closed base, an open top and an exterior wall, wherein the exterior wall comprises a lower portion and an upper portion and wherein the upper portion comprises a threaded neck that extends upwardly from a lip that extends radially inwardly from the lower portion of the wall;

a metal inner cap, wherein the inner cap comprises threads configured to couple with the threaded neck and one or more indentations stamped into a top of the inner cap; and a metal outer cap coupled to the inner cap and configured to selectively engage the inner cap for rotation of the inner cap about the threaded neck;

wherein the outer cap has a top disposed at least partially over the top of the inner cap and comprises one or more indentations stamped into the top of the outer cap;

wherein the one or more indentations stamped into the top of the inner can extend from a superior surface plane of the inner cap;

wherein the one or more indentations stamped into the top of the outer cap extend from a superior surface plane of the outer cap; and wherein the one or more indentations of the outer cap are configured to engage the one or more indentations of the inner cap when pressure is applied to the top of the outer cap in a direction toward the top of the inner cap.

21. The container of claim 20, wherein at least one of the one or more indentations of the outer cap extends downwardly.

22. The container of claim 20, wherein at least one of the one or more indentations of the inner cap extends downwardly.

23. The container of claim 20, wherein all of the one or more indentations of the outer cap extend downwardly.

24. The container of claim 20, wherein all of the one or more indentations of the inner cap extend downwardly.

25. The container of claim 20, wherein the one or more indentations stamped into the top of the outer cap match the one or more indentations stamped into the top of the inner cap.

26. The container of claim 20, wherein the one or more indentations stamped into the top of the outer cap fit at least partially into the one or more indentations stamped into the top of the inner cap.

27. The container of claim 20, wherein the one or more indentations stamped into the top of the inner cap are disposed in a cross formation.

28. The container of claim 20, wherein at least one of the one or more indentations stamped into the top of the outer cap has a rotationally leading edge and a rotationally trailing edge in the clockwise direction, and wherein the leading edge and the trailing edge are disposed at different angles relative to horizontal.

29. A child resistant container comprising:

a container body having a closed base, an open top and an exterior wall, wherein the exteriorwall comprises a lower portion and an upper portion and wherein the upper portion comprises a threaded neck that extends upwardly from a lip that extends radially inwardly from the lower portion of the wall;

a metal inner cap, wherein the inner cap comprises threads configured to couple with the threaded neck and one or more indentations stamped into a top of the inner cap; and a metal outer cap coupled to the inner cap and configured to selectively engage the inner cap for rotation of the inner cap about the threaded neck;

wherein the outer cap has a top disposed at least partially over the top of the inner cap and comprises one or more indentations stamped into the top of the outer cap;

wherein the one or more indentations stamped into the top of the inner cap extend from a superior surface plane of the inner cap;

wherein the one or more indentations stamped into the top of the outer cap extend from a superior surface plane of the outer cap;

wherein the one or more indentations of the outer cap are configured to engage the one or more indentations of the inner cap when pressure is applied to the top of the outer cap in a direction toward the top of the inner cap;

wherein the one or more indentations stamped into the top of the inner cap comprise a plurality of indentations stamped into the top of the inner cap; and wherein the one or more indentations stamped into the top of the outer cap comprise a plurality of indentations stamped into the top of the outer cap.

30. The container of claim 29, wherein the plurality of indentations stamped into the top of the outer cap fit at least partially into the plurality of indentations stamped into the top of the inner cap.

31. The container of claim 29, wherein the plurality of indentations stamped into the top of the outer cap match the plurality of indentations stamped into the top of the inner cap.

32. A child resistant container comprising:

a container body having a closed base, an open top and an exterior wall, wherein the exteriorwall comprises a lower portion and an upper portion and wherein the upper portion comprises a threaded neck that extends upwardly from a lip that extends radially inwardly from the lower portion of the wall;

a metal inner cap, wherein the inner cap comprises threads configured to couple with the threaded neck and one or more indentations stamped into a top of the inner cap; and a metal outer cap coupled to the inner cap and configured to selectively engage the inner cap for rotation of the inner cap about the threaded neck;

wherein the outer cap has a top disposed at least partially over the top of the inner cap and comprises one or more indentations stamped into the top of the outer cap;

wherein the one or more indentations stamped into the top of the inner cap extend from a superior surface plane of the inner cap;

wherein the one or more indentations stamped into the top of the outer cap extend from a superior surface plane of the outer cap;

wherein the one or more indentations of the outer cap are configured to engage the one or more indentations of the inner cap when pressure is applied to the top of the outer cap in a direction toward the top of the inner cap;

wherein the one or more indentations stamped into the top of the inner cap comprise a plurality of indentations stamped into the top of the inner cap;

wherein the one or more indentations stamped into the top of the outer cap comprise a plurality of indentations stamped into the top of the outer cap;

wherein the plurality of indentations stamped into the top of the outer cap extend downwardly.

33. The container of claim 32, wherein the plurality of indentations stamped into the top of the inner cap extend downwardly.

* * * * *